US008800823B2

(12) United States Patent
Sweeton

(10) Patent No.: US 8,800,823 B2
(45) Date of Patent: Aug. 12, 2014

(54) TRIGGER SPRAYER AND VALVE SYSTEM

(75) Inventor: Steven L. Sweeton, Lake Winnebago, MO (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 0 days.

(21) Appl. No.: 13/697,553

(22) PCT Filed: May 13, 2011

(86) PCT No.: PCT/US2011/036432

§ 371 (c)(1), (2), (4) Date: Nov. 13, 2012

(87) PCT Pub. No.: WO2011/143555

PCT Pub. Date: Nov. 17, 2011

(65) Prior Publication Data

US 2013/0056499 A1 Mar. 7, 2013

Related U.S. Application Data

(60) Provisional application No. 61/334,816, filed on May 14, 2010.

(51) Int. Cl.
*B67D 7/58* (2010.01)

(52) U.S. Cl.
USPC ..... 222/383.1; 222/340; 222/481.5; 239/333

(58) Field of Classification Search
USPC ..... 222/383.1, 372, 321.7, 340–341, 384, 222/481.5; 239/333
See application file for complete search history.

(56) References Cited

U.S. PATENT DOCUMENTS

| | | | | |
|---|---|---|---|---|
| 6,116,472 | A * | 9/2000 | Wanbaugh et al. | 222/340 |
| 7,175,056 | B2 | 2/2007 | Buti | |
| 7,311,227 | B2 * | 12/2007 | Foster | 222/383.1 |
| 7,341,168 | B2 | 3/2008 | Shanklin et al. | |
| 7,571,836 | B2 | 8/2009 | Foster et al. | |
| 7,712,636 | B2 * | 5/2010 | Foster et al. | 222/340 |
| 7,942,291 | B2 * | 5/2011 | Foster | 222/384 |
| 7,967,171 | B2 * | 6/2011 | Foster et al. | 222/383.1 |
| 2007/0215648 | A1 | 9/2007 | Foster et al. | |
| 2007/0295757 | A1 * | 12/2007 | Foster et al. | 222/340 |

OTHER PUBLICATIONS

International Search Report from PCT/US2011/036432 mailed Aug. 25, 2011.

* cited by examiner

*Primary Examiner* — Frederick C Nicolas
(74) *Attorney, Agent, or Firm* — MeadWestvcao Intellectual Property Group

(57) ABSTRACT

A valve system for a trigger sprayer including a valve forming an air spring with a portion of the trigger sprayer and being made of a flexible or elastomeric material. The trigger sprayer may include an air-spring valve system wherein the air-spring valve system provides precompression during a pump stroke. The precompression forces developed in the valve system during a pump stroke may originate from an air valve or air pocket trapped between a portion of a valve body and a part of the valve system. For example, a valve may be inserted in a tube retainer which is connected to a valve body of a trigger sprayer. Air trapped in a chamber or space between a portion of the valve and the tube retainer may provide a force against the valve such that a certain force must be applied to the valve before it allows product to be released.

17 Claims, 5 Drawing Sheets

TRIGGER SPRAYER AND VALVE SYSTEM

CROSS-REFERENCE TO RELATED APPLICATIONS

This application is a National Stage Entry of International Application PCT/US 11/36432, filed May 13, 2011 which claims the benefit of U.S. Provisional Application No. 61/334,816, entitled "TRIGGER SPRAYER AND VALVE SYSTEM," filed 14 May 2010, both of which are incorporated herein by reference in their respective entireties.

BACKGROUND OF THE INVENTION

1. Field of the Invention

The present invention relates to trigger sprayer valve devices and more particularly to valve systems and precompression valve systems for such trigger sprayer devices.

2. State of the Art

Trigger sprayers, trigger sprayer devices, and trigger actuated pump sprayers are well known and their use is commonplace in many households and businesses. Typically, a trigger sprayer includes a pump chamber whose volume is varied by movement of a piston within the pump chamber. The piston is typically biased by a spring and is attached to a trigger lever. Actuation of the trigger lever moves the piston within the pump chamber and compresses the spring; this is sometimes referred to as the pump stroke or pressure pump stroke. Release of the trigger lever releases the force on the spring and the spring pushes the piston back to a resting position; which is sometimes called the suction stroke or return stroke. A typical trigger sprayer also includes an inlet valve and an outlet valve. During the pump stroke, product in the pump chamber is pressurized and upon reaching a certain pressure the outlet valve is opened, allowing the product in the pump chamber to escape through the outlet valve. During the return stroke, the outlet valve is shut and the inlet valve is opened. The return of the piston caused by the spring force draws product through the inlet valve into the pump chamber. A typical trigger sprayer will also include a dip-tube for delivering product to the trigger sprayer inlet valve, and an orifice for dispersing the product exiting the outlet valve. The orifice may be attached to or included in a nozzle which is part of the trigger sprayer.

In some instances, it may be advantageous for a trigger sprayer to include a precompression system which is actuated during the pump stroke. A precompression system allows pressure in the trigger sprayer to build-up before product is released or sprayed from the trigger sprayer. The inclusion of a precompression system may provide beneficial results to the spray mechanics or may improve dispersion of a product from a trigger sprayer. Because of these and other advantages, perceived or real, trigger sprayers with precompression systems are in demand.

Examples of trigger sprayers and trigger sprayer systems which include precompression systems are described and illustrated in the following United States patents and patent applications which are incorporated herein by reference in their entireties: U.S. Pat. No. 5,522,547; U.S. Pat. No. 6,131,820; and U.S. Patent Application Publication 2008/0149671.

Trigger sprayer systems employing plastic parts, nonmetal parts, or a reduced number of parts are also desired. For example, PCT Patent Application PCT/US10/031970 describes such systems and is incorporated herein in its entirety by reference.

Thus, it may be desirable to develop a simple valve system, such as a precompression valve system, for trigger sprayers.

BRIEF SUMMARY OF THE INVENTION

According to certain embodiments of the invention, a trigger sprayer may include an air-spring valve system wherein the air-spring valve system provides precompression during a pump stroke. The precompression forces developed in the valve system during a pump stroke may originate from an air valve or air pocket trapped between a portion of a valve body and a part of the valve system. For example, a valve may be inserted in a tube retainer which is connected to a valve body of a trigger sprayer. Air trapped in a chamber or space between a portion of the valve and the tube retainer may provide a force against the valve such that a certain force must be applied to the valve before it allows product to be release from the trigger sprayer. Pressure applied to the product is transferred to the valve. At that point where the pressure applied to the product overcomes the pressure applied to the valve by the air-spring, the product is released.

According to certain embodiments of the invention, a trigger sprayer may include seven parts: a tube retainer, a valve inserted in the tube retainer, a valve body, an integrated trigger/spring, a piston, a nozzle, and a shroud. The valve may be inserted into the tube retainer such that an air-spring is formed. The air-spring may maintain a constant load or force on the valve such that the valve provides a sealed or closed position for a discharge passage through the valve body.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention a valve system for a trigger sprayer may include a valve positioned within, or configured to work with, a portion of a tube retainer or portion of a trigger sprayer valve body such that an air pocket is formed between the valve and the portion of the tube retainer or trigger sprayer valve body. The air pocket formed between the valve and tube retainer or trigger sprayer valve body may apply a constant load or force against the valve. As a trigger sprayer incorporating a valve system according to embodiments of the invention is actuated, fluid may apply pressure to the valve. Once the pressure of the fluid on the valve exceeds the load or force applied by the air on the valve, the valve may open, allowing product to escape through a discharge passage in the valve body. Thus, a valve system may provide precompression force for the discharge of a product from a trigger sprayer.

Figure 1:
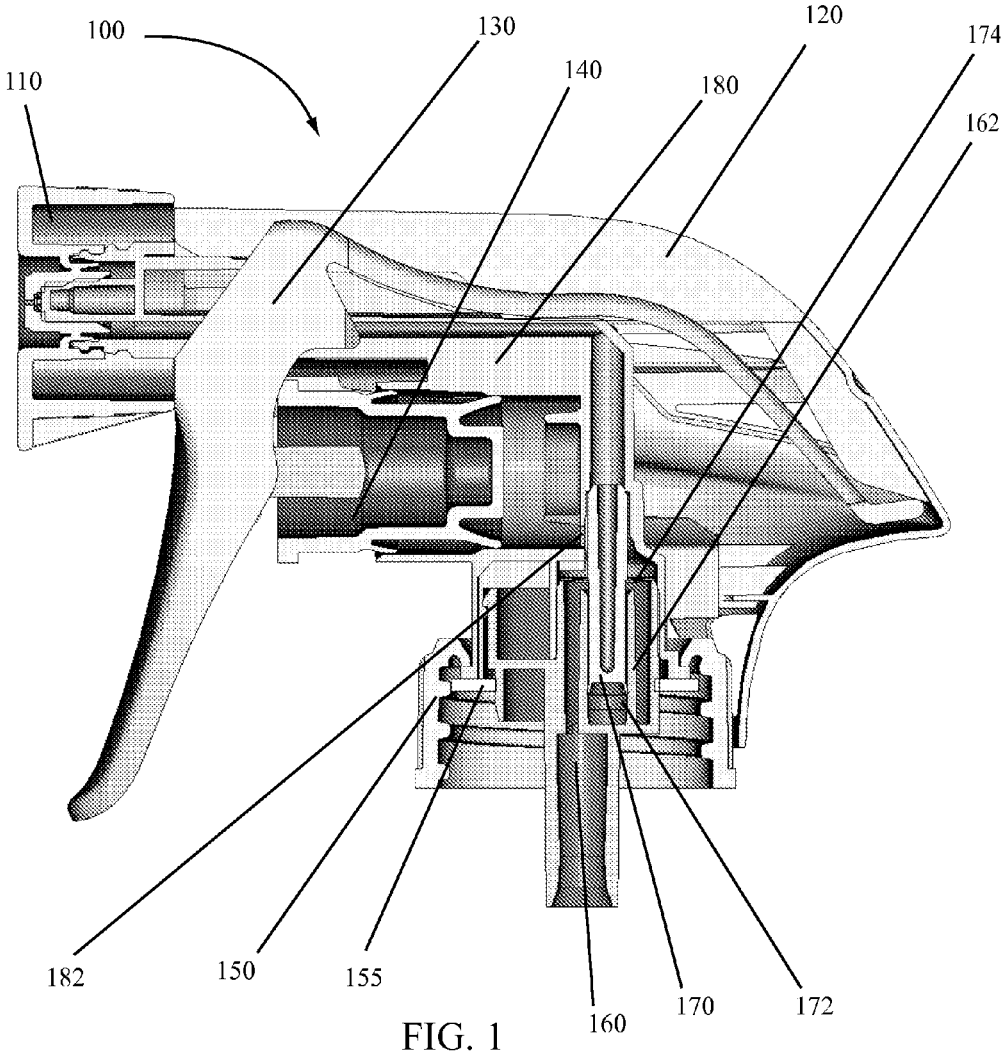
FIG. 1 illustrates a cross-sectional view of a trigger sprayer according to various embodiments of the invention.

A trigger sprayer 100 incorporating a valve system according to embodiments of the invention is illustrated in FIG. 1. The cross-sectional view of the trigger sprayer 100 in FIG. 1 illustrates a nozzle 110, a shroud 120, an integrated trigger and spring 130, a piston 140, a closure 150, a seal 155, a tube retainer 160, a valve 170, and a valve body 180. In certain embodiments of the invention, a nozzle 110 may be mounted at a discharge opening located in the valve body 180. A piston 140 may be seated in a piston bore within the valve body 180. An integrated trigger and spring 130 may be configured to actuate the piston 140 upon actuation of the integrated trigger and spring 130 as a spring portion of the integrated trigger and spring 130 acts against a shroud 120. In other embodiments, a conventional trigger and spring may be substituted or used in place of the integrated trigger and spring 130 illustrated in FIG. 1. A tube retainer 160 may be fitted into a portion of the valve body 180 and a valve 170 may be positioned in the tube retainer 160 as illustrated in FIG. 1. A closure 150 and an optional seal 155 may be included with the trigger sprayer 100 to attached or secure the trigger sprayer 100 to a container or bottle as desired. In other embodiments, a valve body 180 my include lug fitments or bayonet lug attachments for fitting the trigger sprayer 100 to a container or bottle configured for a bayonet type attachment.

According to certain embodiments of the invention, a tube retainer 160 may include a valve compartment 162 configured to retain or accept a portion of a valve 170 therein. As illustrated in FIG. 1, a portion of the valve 170 may be positioned in the valve compartment 162 of the tube retainer 160. The valve 170 may include one or more flanges 172 which seal against a portion of the interior of the valve compartment. Air trapped between the tube retainer 160 and the valve 170 forms an air pocket which applies a force to the valve 170. A tube retainer 160 may also include a fluid passageway between a container or bottle and a discharge passage in the valve body 180.

According to embodiments of the invention, the positioning of a valve 170 in relation to a tube retainer 160 may be as illustrated in FIG. 1 wherein an air pocket is trapped between the valve 170 and a portion of the tube retainer 160 in the valve compartment 162 of the tube retainer. In other embodiments, a valve 170 may be configured to fit within the tube retainer 160 in another manner or may be configured to mate with the valve body 180 or other feature to form a desired air pocket which is capable of exerting a load on the valve 170 when assembled in a trigger sprayer 100.

The valve 170 may also be configured to fit into a portion of the valve body 180 and in particular into a portion of a discharge passageway between the piston 140 and the nozzle 110 of the trigger sprayer 100. As illustrated in FIG. 1, the valve 170 extends into a discharge passageway of the valve body 180. An end of the valve 170 opposite the one or more flanges 172 may sit in the valve body 180 discharge passage such that the discharge passage is sealed or such that fluid from within the piston bore of the valve body 180 will not leak to the nozzle 110. The valve 170 may seal an opening 182 in the piston bore of the valve body 180 between the piston bore and the discharge passage or may seal with the discharge passage downstream of the piston bore. As illustrated in FIG. 1, the valve 170 seals a portion of the discharge passage in the valve body 180 which is downstream of the piston bore.

A valve 170 according to embodiments of the invention may also include a flap valve 174 configured to seat on a portion of the tube retainer 160. The flap valve 174 may overlie a fluid passageway in the tube retainer and may prevent flow of fluid from a container or bottle into the valve body 180 of the trigger sprayer 100. As illustrated in FIG. 1, a flap valve 174 may sit or overlie a portion of the tube retainer 160. The flap valve 174 may be flexible and may allow the valve 170 to move in relation to the flap valve 174.

A valve 170 according to embodiments of the invention may be made of a flexible or elastomeric material. For example, a valve 170 may be made of a plastic material, silicon material, urethane material, ethylene material or any other material as desired. In some embodiments of the invention, a material used to make the valve 170 may be selected based on compatibility with materials or fluids which will come in contact with the valve 170. In other embodiments, the material may be selected to impart a certain strength or rigidity to the valve 170. In still other embodiments, a valve 170 may be made using more than one material such as by using two materials bi-injected to form a valve 170.

Figure 2:
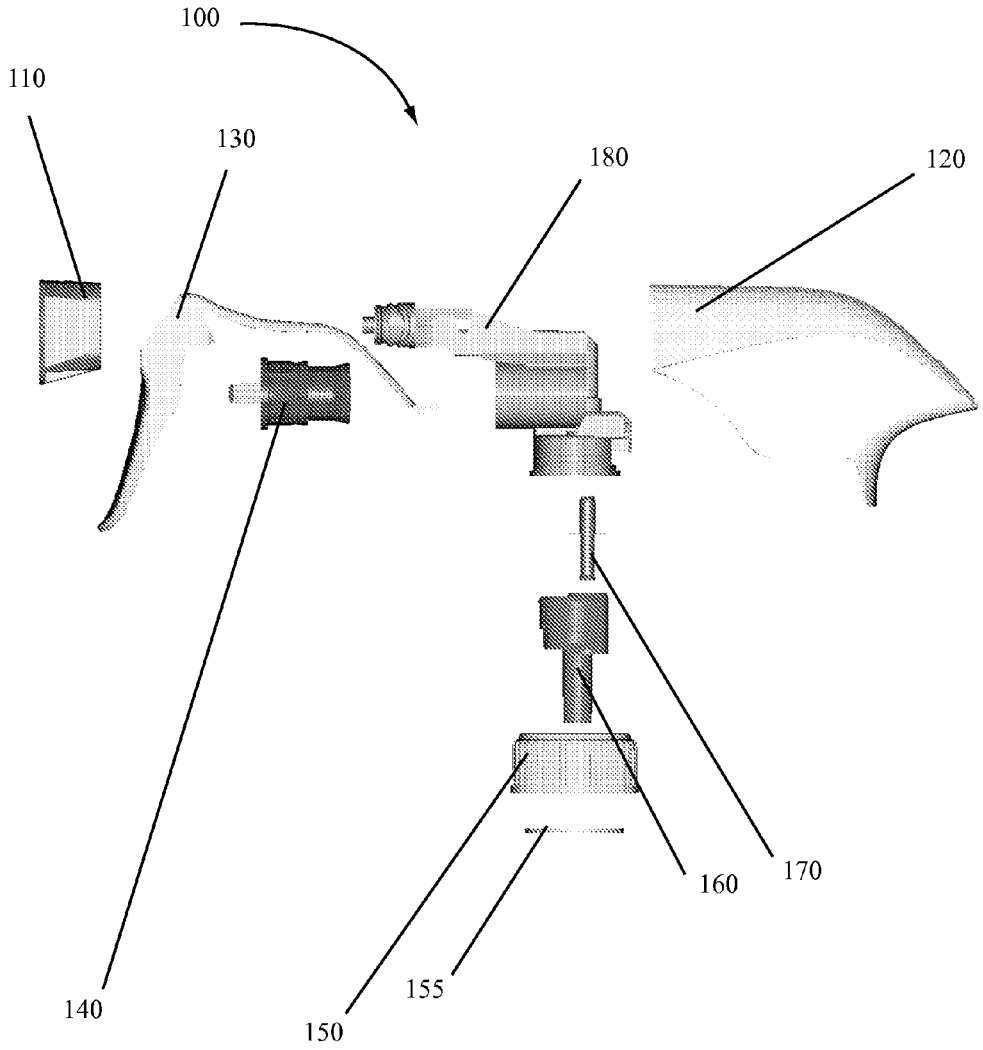
FIG. 2 illustrates a blown apart view of components of a trigger sprayer according to various embodiments of the invention.

FIG. 2 illustrates a blown-apart view of a trigger sprayer 100 according to various embodiments of the invention.

Figure 3:
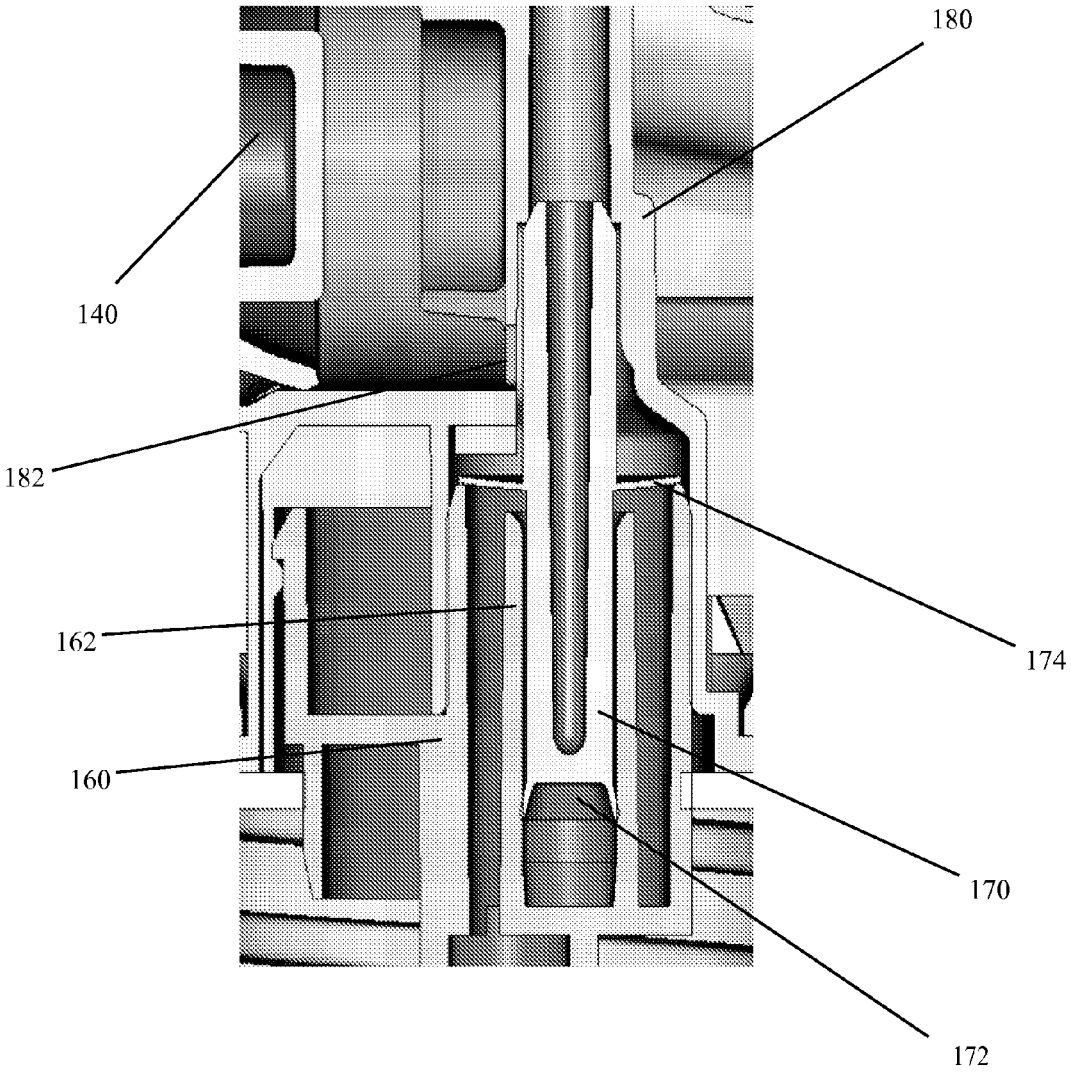
FIG. 3 illustrates a close-up, cross-sectional view of a valve system according to embodiments of the invention.
Figure 4:
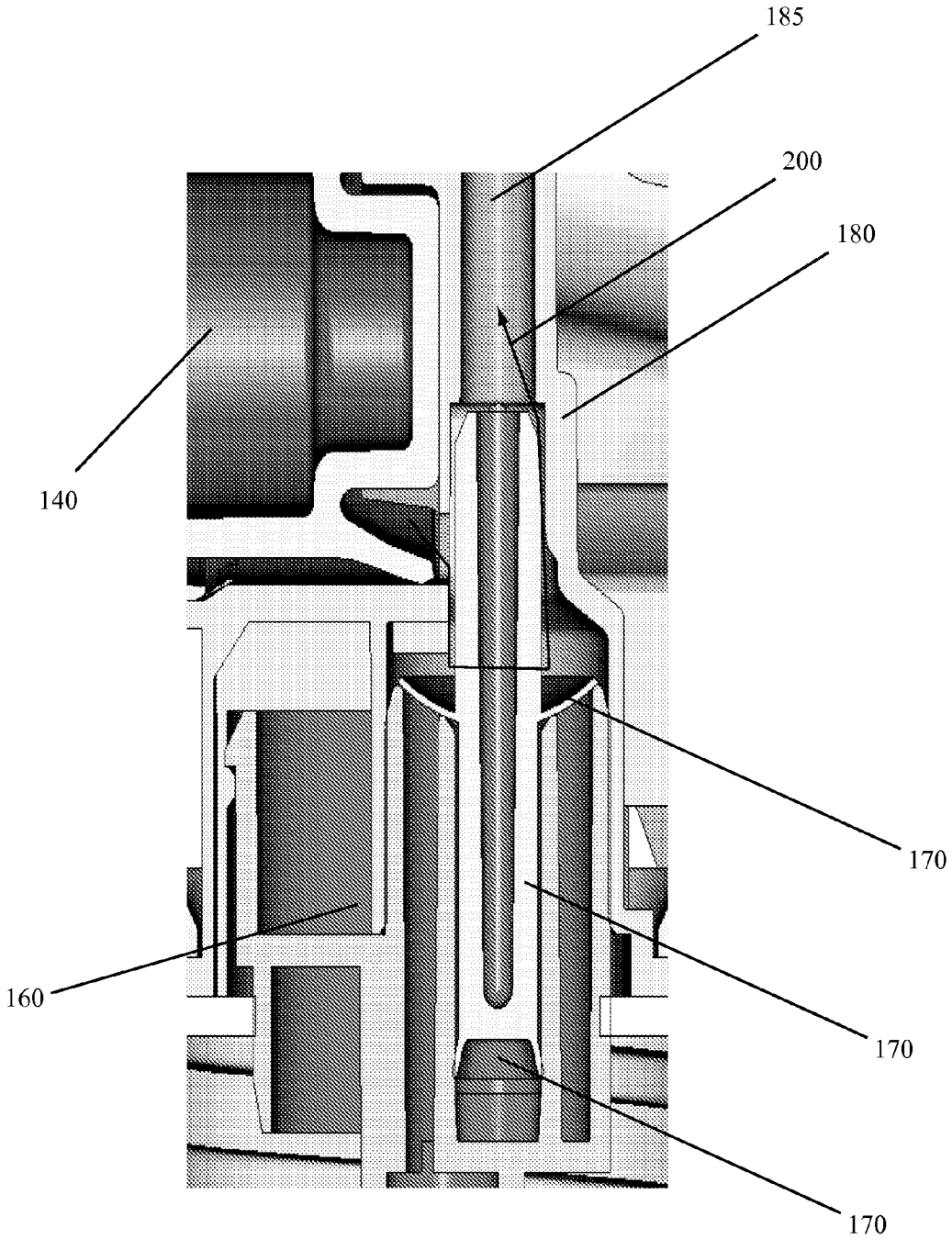
FIG. 4 illustrates a close-up, cross-sectional view of a valve system according to embodiments of the invention.
Figure 5:
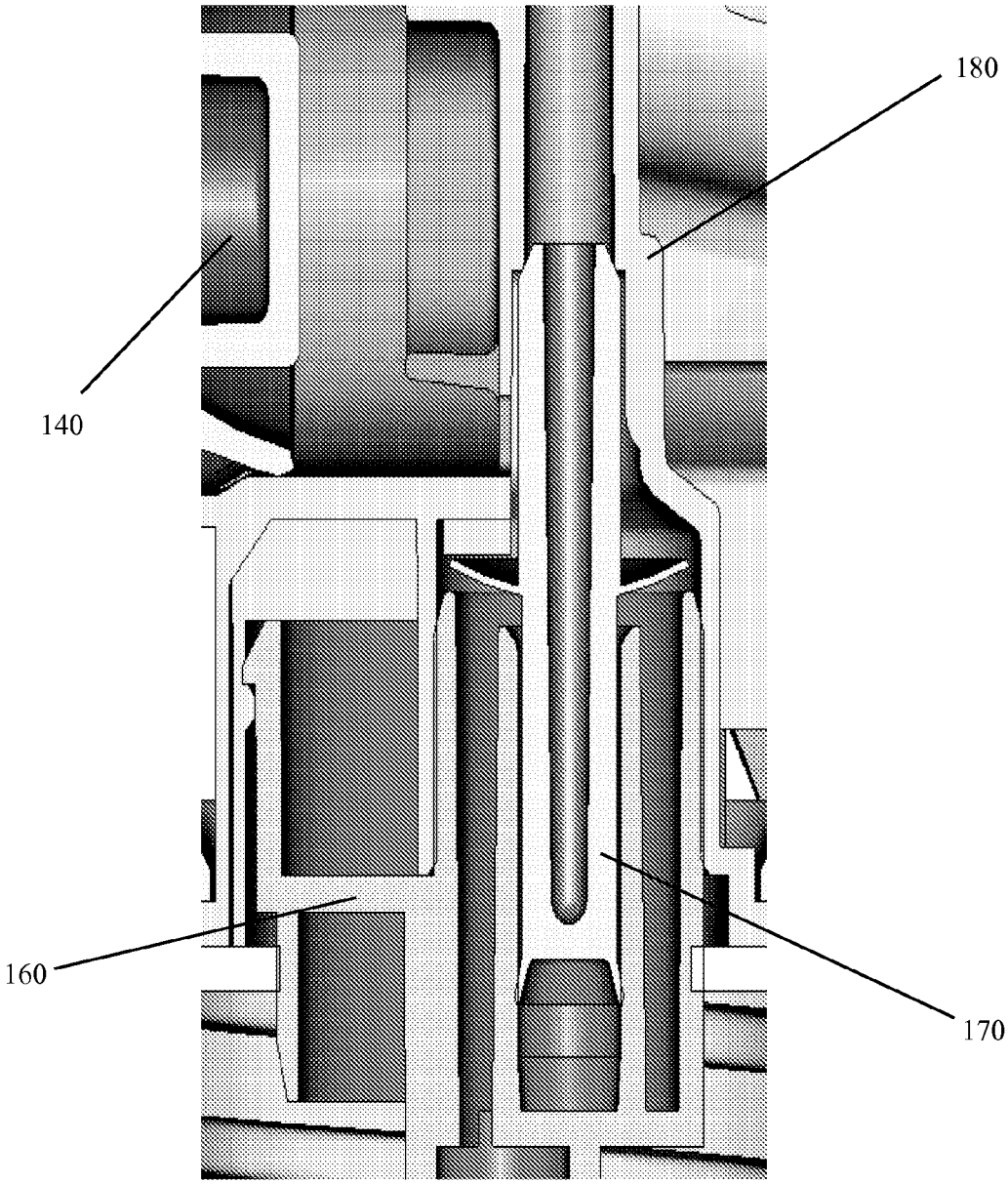
FIG. 5 illustrates a close-up, cross-sectional view of a valve system according to embodiments of the invention.

FIGS. 3 through 5 illustrate close-up views of a valve 170 in a trigger sprayer 100 according to embodiments of the invention. In FIG. 3, the valve 170 is illustrated at rest which occurs when the trigger sprayer 100 is not in an actuated state or when the trigger sprayer 100 is not in a pump stroke or return stroke state. In FIG. 4, the valve 170 is illustrated during actuation, or during a pump stroke. FIG. 5 illustrates the valve 170 during the return stroke after actuation has occurred.

As illustrated in FIG. 3, when the trigger sprayer 100 is at rest or when forces are not being applied to the integrated trigger and spring 130 during a pump stroke or return stroke, the valve 170 is positioned in the tube retainer 160 and in some instances in a valve compartment 162 of the tube retainer 160. One or more flanges 172 of the valve 170 seal against an interior wall of the valve compartment 162, forming an air pocket between the valve 170 and the tube retainer 160. The air in the air compartment exerts a load on the valve 170 which holds the valve 170 in position or pushes the valve 170 up against a portion of the valve body 180. Contact between the valve 170 and the valve body 180 above an opening 182 in the piston bore seals a discharge passage through the valve body 180. Fluid sits in the piston bore between the piston 140 and the valve body 180 and in a portion of the space between the valve body 180 and the flap valve 174. The flap valve 174 may rest on a portion of the tube retainer 160 and may prevent fluid from within the piston bore and space from leaking or flowing back into the tube retainer 160 and container or bottle to which the trigger sprayer 100 is attached.

As illustrated in FIG. 3, air in the space between the valve 170 and tube retainer 160 maintains a constant load on the valve 170 which holds the seal between the valve 170 and the valve body 180, thereby preventing fluid from flowing or leaking out the discharge passageway of the valve body 180. Fluid in the piston bore and in the discharge passage space between the valve body 180 and flap valve 174 creates a pre-load on the flap valve 174, maintaining prime and preventing fluid from leaking back through the tube retainer 160 into a container or bottle.

Upon actuation of a trigger of a trigger sprayer 100 according to embodiments of the invention, the valve 170 responds as illustrated in FIG. 4. Actuation of a trigger, such as an integrated trigger and spring 130, moves piston 140 such that piston 140 forces fluid through the opening 182 in the valve body 180. The fluid cannot pass into the discharge passage 185 due to the seal between the valve 170 and the valve body 180. Thus, the fluid pushes on the flap valve 174 which is flexible. Force applied to the fluid deforms the flap valve 174 and moves the valve 170 accordingly. However, forces or load applied by the air in the space between the valve 170 and tube retainer 160 acts against the movement of the valve 170. Once the force or load applied by the air in the space is overcome by the forces applied to the flap valve 174 by the fluid and actuation of the piston 140, the valve 170 is unseated at the point where it is in contact with the valve body 180. The unseating of the valve 170 allows fluid to pass into the discharge passage 185 of the valve body 180. Fluid may then flow along fluid path 200 out of the trigger sprayer 100 or through the nozzle 110. When the force or load applied by the air in the space between the valve 170 and the tube retainer 160 is greater than the force being applied to the flap valve 174, the air forces the valve 170 shut and pushes the valve 170 back into contact with the valve body 180.

According to embodiments of the invention, when a valve 170, such as that illustrated in FIGS. 1 through 5, is incorporated with a trigger sprayer 100, pressure from air in the space between the valve 170 and the tube retainer 160 dictates the pressure at which the valve 170 will unseat from the valve body 180. As fluid pressure pushes on the flap valve 174, which may be a disk, the valve 170 is moved opposite the pressure from the fluid. The valve 170 then unseats from the valve body 180 when the pressure exceeds the load or force exerted by the air on the valve 170. Fluid is then released from the trigger sprayer 100.

The valve 170 may therefore act as a precompression valve because fluid is not released from the trigger sprayer 100 until a certain pressure is exerted on the fluid which is sufficient to move the valve 170. The increased pressure provided on the fluid at the point of discharge may be beneficial.

According to embodiments of the invention, the size, shape, and other characteristics of the space between the valve 170 and the tube retainer 160, or the geometrical configuration thereof, may be altered to provide sufficient space or air to achieve a desired discharge valve opening pressure. In some embodiments of the invention, the valve 170 may open at 10 psi. In other embodiments, the configuration of the valve 170 and tube retainer 160 may be altered to increase or decrease the pressure required to unseat the valve 170 from the valve body 180. In still other embodiments, the material of the valve 170 may be changed to alter the pressure required to unseat the valve 170. For example, the material of the valve 170 or the shape and size of the flap valve 174 may be altered to require a higher or lower pressure to unseat the valve 170 from the valve body 180. The material of the valve 170 may also be altered with the size and shape of the air space such that both the material and the air space contribute to the amount of force necessary to unseat the valve 170.

FIG. 5 illustrates a valve 170 according to embodiments of the invention during a return stroke. As piston 140 is moved in the piston bore by force exerted by a trigger and spring or an integrated trigger and spring 130, the piston 140 forms a vacuum which lifts at least a portion of the flap valve 174 away from contact with the tube retainer 160 and draws fluid from a container or bottle connected to the trigger sprayer 100 into the piston bore. The force exerted by the retreating piston 140 may also lift the valve 170, facilitating the re-seating of the valve 170 against a portion of the valve body 180. Once the piston 140 stops moving, the flap valve 174 seals against the tube retainer 160, and the valve 170 is back in the position illustrated in FIG. 3.

According to embodiments of the invention, a valve 170 such as that illustrated in FIGS. 1 through 5 may be used to provide precompression to a trigger sprayer 100.

A trigger sprayer 100 according to embodiments of the invention may be fitted to a bottle or container in any conventional manner.

According to certain embodiments of the invention, a valve 170 for a trigger sprayer may include a valve body, at least one valve flange 172, a flap valve 174 and a discharge closure. For example, the valve 170 illustrated in FIGS. 1 through 5 includes one or more flanges 172 for forming an air piston with another body. The flap valve 174 may be positioned between the one or more flanges 172 and a discharge end of the valve 170. The discharge end of the valve 170 may seal against a portion of a trigger sprayer 100 to prevent discharge of fluid from the trigger sprayer 100. The valve 170 may be made as a single molded part form molded plastic, resin, or other material and may be flexible or elastomeric. Alternatively, a valve 170 may be made from multiple parts or materials to provide desired characteristics.

While various embodiments of the invention illustrated herein depict a trigger sprayer having an integrated trigger and spring combination, it is understood that valve systems according to embodiments of the invention may be incorporated with trigger sprayers having traditional metal springs and trigger systems. It is also understood that the valve systems according to embodiments of the invention may be incorporated with any trigger sprayer as desired.

In addition, valve systems according to embodiments of the invention may be incorporated into a finger pump which does not use a trigger to actuate a pump. For example, a valve system according to embodiments of the invention may be incorporated with a finger pump, table-top pump, or hand pump which are well known and used primarily for personal care products, lotions, soaps, and the like.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A trigger sprayer, comprising:
- a valve body;
- a piston bore in the valve body;
- a discharge passage in the valve body in communication with the piston bore through an opening;
- a piston positioned in the piston bore;
- a trigger connected to the piston;
- a tube retainer fitted into a portion of the valve body;
- a valve compartment in the tube retainer; and
- a valve, comprising:
  - at least one flange seated within the valve compartment of the tube retainer, wherein the at least one flange and valve compartment form an air pocket between the at least one flange and valve compartment; and
  - a flap valve resting on at least a portion of the tube retainer.

2. The trigger sprayer of claim 1, wherein the air pocket applies a load on the valve.

3. The trigger sprayer of claim 1, wherein the valve comprises a valve made of a material selected from the group consisting of plastic, silicon, a urethane material, and an ethylene material.

4. The trigger sprayer of claim 1, wherein the valve is elastomeric.

5. The trigger sprayer of claim 1, wherein the valve is flexible.

6. The trigger sprayer of claim 1, wherein the valve further comprises a discharge closure seated in the discharge passage.

7. The trigger sprayer of claim 1, wherein the valve further comprises a discharge closure seated in the discharge passage upstream of the opening (182) between the piston bore and the discharge passage.

8. The trigger sprayer of claim 1, wherein the flap valve resting on at least a portion of the tube retainer further comprises a flap valve overlying a fluid passageway through the tube retainer.

9. The trigger sprayer of claim 1, wherein the flap valve comprises a flap valve in the shape of a disk.

10. A valve system, comprising:

a tube retainer comprising a valve compartment and a fluid passageway;

a valve, comprising:

at least one flange seated in the valve compartment;

a flap valve overlying the fluid passageway in the tube retainer; and an air pocket between the at least one flange and a portion of the valve compartment.

11. The valve system of claim 10, wherein the valve comprises a valve comprising a material selected from the group consisting of plastic, silicon, a urethane material, and an ethylene material.

12. The valve system of claim 10, further comprising an air tight seal between the at least one flange and the valve compartment.

13. The valve system of claim 10, wherein the flap valve is flexible.

14. The valve system of claim 10, wherein the valve is elastomeric.

15. The valve system of claim 10, further comprising a valve body, wherein the tube retainer and valve are seated in at least a portion of the valve body and the valve further comprises a discharge closure seated in a discharge passage of the valve body.

16. The valve system of claim 10, wherein the air pocket acts as an air spring on the valve.

17. The valve system of claim 10, wherein the air pocket exerts a load on the valve.

* * * * *